US007011553B2

(12) United States Patent
Hayashi et al.

(10) Patent No.: US 7,011,553 B2
(45) Date of Patent: Mar. 14, 2006

(54) CABLE CONNECTOR HAVING A RETAINER WHICH SERVES TO HOLD A CABLE, TO PROTECT A CONNECTING PORTION, AND TO PREVENT UNDESIRABLE RELEASING OF A CONTACT

(75) Inventors: Yasufumi Hayashi, Tokyo (JP); Terumi Nakaya, Aomori (JP); Takashi Yanagihara, Tochigi (JP); Nobuhiro Koyota, Tochigi (JP); Naotaka Kumakiri, Tochigi (JP)

(73) Assignees: Japan Aviation Electronics Industry, Limited, Toyko (JP); JAE Hirosaki, Ltd., Hirosaki (JP); Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/977,739

(22) Filed: Oct. 29, 2004

(65) Prior Publication Data

US 2005/0095924 A1 May 5, 2005

(30) Foreign Application Priority Data

Oct. 30, 2003 (JP) ..... 2003-370604

(51) Int. Cl.
*H01R 13/514* (2006.01)

(52) U.S. Cl. ..... 439/752; 439/460; 439/942

(58) Field of Classification Search ..... 439/752, 439/460, 942, 407, 399, 866, 867, 877
See application file for complete search history.

(56) References Cited

U.S. PATENT DOCUMENTS 3,670,293 A * 6/1972 Garver ..... 439/585
3,728,787 A * 4/1973 McDonough ..... 29/877
3,964,815 A * 6/1976 McDonough ..... 439/423
4,307,926 A * 12/1981 Smith ..... 439/610
4,371,225 A * 2/1983 Narozny ..... 439/442
4,386,817 A * 6/1983 Benker et al. ..... 439/460
4,391,482 A * 7/1983 Desourteaux ..... 439/271
4,673,231 A * 6/1987 McAnulty, Sr. ..... 439/587
4,840,578 A * 6/1989 Sato ..... 439/395
4,892,488 A * 1/1990 Nestor et al. ..... 439/438
4,946,408 A * 8/1990 Garrett et al. ..... 439/872
5,120,259 A * 6/1992 Nakata et al. ..... 439/585
5,131,864 A * 7/1992 Van Zeelst et al. ..... 439/460
5,133,677 A * 7/1992 Sato et al. ..... 439/585
5,145,409 A * 9/1992 Sato et al. ..... 439/585
5,246,384 A * 9/1993 Sato ..... 439/585
5,254,021 A * 10/1993 Yamamoto et al. ..... 439/866
5,292,261 A * 3/1994 Hirano et al. ..... 439/752
5,314,351 A * 5/1994 Yamamoto ..... 439/407
5,346,414 A * 9/1994 Sakai et al. ..... 439/752

(Continued)

FOREIGN PATENT DOCUMENTS

JP H05-68082 10/1993

(Continued)

*Primary Examiner*—Tho D. Ta
*Assistant Examiner*—Larisa Tsukerman
(74) *Attorney, Agent, or Firm*—Collard & Roe, P.C.

(57) ABSTRACT

In a connector to be connected to a cable having a core wire, a retainer is fitted into a rear portion of an insulator holding a contact. The core wire is crimped by a wire crimping barrel formed to the contact. The cable is clamped in cooperation with the retainer and the insulator and extracted through the rear portion of the insulator. In addition, the contact has a locking barrel. On the other hand, the retainer includes a locking portion which is engaged with the locking barrel to prevent the contact from being released rearward from the insulator.

14 Claims, 2 Drawing Sheets

U.S. PATENT DOCUMENTS

| | | | | | |
|---|---|---|---|---|---|
| 5,445,535 | A | * | 8/1995 | Phillips et al. | 439/394 |
| 5,603,636 | A | * | 2/1997 | Kanou et al. | 439/585 |
| 5,607,318 | A | * | 3/1997 | Wakata et al. | 439/274 |
| 5,694,620 | A | * | 12/1997 | Wilk et al. | 396/6 |
| 5,746,628 | A | * | 5/1998 | Yamamoto | 439/752 |
| 5,772,454 | A | * | 6/1998 | Long, Jr. | 439/83 |
| 5,857,876 | A | * | 1/1999 | Hatagishi | 439/752 |
| 5,879,192 | A | * | 3/1999 | Machida et al. | 439/598 |
| 5,885,104 | A | * | 3/1999 | Foster et al. | 439/580 |
| 5,890,927 | A | | 4/1999 | Norimichi | |
| 5,908,326 | A | * | 6/1999 | Neuhauser et al. | 439/399 |
| 6,083,034 | A | * | 7/2000 | Kameyama | 439/394 |
| 6,139,374 | A | * | 10/2000 | Kennedy et al. | 439/752 |
| 6,255,590 | B1 | | 7/2001 | Sato | |
| 6,380,485 | B1 | * | 4/2002 | Beaman et al. | 174/88 R |
| 6,394,836 | B1 | * | 5/2002 | Nagai | 439/422 |
| 6,410,853 | B1 | * | 6/2002 | Peters et al. | 174/84 R |
| 6,425,780 | B1 | * | 7/2002 | Muhlmichel | 439/460 |
| 6,558,208 | B1 | * | 5/2003 | Suzuki | 439/878 |
| 6,831,230 | B1 | * | 12/2004 | Ide et al. | 174/84 R |
| 6,948,970 | B1 | * | 9/2005 | Hayashi et al. | 439/460 |
| 2002/0062979 | A1 | * | 5/2002 | Murakami et al. | 174/117 F |
| 2002/0157855 | A1 | * | 10/2002 | Ide et al. | 174/84 R |
| 2004/0253880 | A1 | * | 12/2004 | Correll et al. | 439/752 |

FOREIGN PATENT DOCUMENTS

| | | |
|---|---|---|
| JP | 11-307216 | 5/1999 |
| WO | WO 95/28021 | 10/1995 |

* cited by examiner

CABLE CONNECTOR HAVING A RETAINER WHICH SERVES TO HOLD A CABLE, TO PROTECT A CONNECTING PORTION, AND TO PREVENT UNDESIRABLE RELEASING OF A CONTACT

This invention claims priority to prior Japanese Patent Application JP 2003-370604, the disclosure of which is incorporated herein by reference.

BACKGROUND OF THE INVENTION

This invention relates to a cable connector for use in connecting a cable such as a coaxial cable.

For example, Japanese Patent Application Publication (JP-A) No. H11-307216 (corresponding to U.S. Pat. No. 6,255,590) discloses a connecting method comprising the steps of placing a lead wire on a cable, and then subjecting the lead wire and the cable to ultrasonic welding by the use of an ultrasonic welding horn so as to join a conductor of the cable and a conductor of the lead wire. According to the connecting method, a direction or orientation of the ultrasonic welding horn is restricted. Therefore, in case of a multi-cable connector for connecting a number of cables in an integrated arrangement, the degree of freedom in designing a contact array is low. Further, a part subjected to ultrasonic welding is not covered with an insulator. This results in a problem in view of protection.

Japanese Utility Model Application Publication (JP-U) No. H5-68082 discloses a double-lock connector. The double-lock connector has a double-lock member for locking a contact to an insulator. The contact is smoothly inserted through the double-lock member into a contact receiving chamber of the insulator. However, a cable is in a free state without being held by the insulator. This results in a problem that an excessive load tends to be applied upon a connecting portion between a conductor of the cable and the contact.

SUMMARY OF THE INVENTION

It is therefore an object of the present invention to provide a cable connector which is capable of stably holding a cable, protecting a connecting portion between a conductor of the cable and a contact, and reliably preventing the contact from being undesirably released from the insulator.

Other objects of the present invention will become clear as the description proceeds.

According to an aspect of the present invention, there is provided a connector to be connected to a cable having a core wire, the connector comprising a contact having a wire crimping barrel crimped on the core wire and a locking barrel, an insulator holding the contact and having a rear portion through which the cable is extracted, and a retainer fitted into the rear portion of the insulator, the retainer including a locking portion engaged with the locking barrel to prevent the contact from being released rearward from the insulator and a cable holding portion clamping the cable in cooperation with the insulator.

According to another aspect of the present invention, there is provided a connector to be connected to a coaxial cable having a core wire, a core wire coating portion coating the core wire, a shield wire, and a shield wire coating portion coating the shield wire, the connector comprising first and second contacts, an insulator holding the first and the second contacts and having a rear portion through which the coaxial cable is extracted, and a retainer held by the insulator, the first contact including a wire crimping barrel crimped on the core wire and a locking barrel for locking the first contact, the second contact including a wire crimping barrel crimped on the shield wire and a locking barrel for locking the second contact, the retainer including first and second locking portions fitted into a rear portion of the insulator and engaged with the locking barrels of the first and the second contacts to lock the first and the second contacts, respectively, and a cable holding portion for holding the coaxial cable in cooperation with the insulator.

DESCRIPTION OF THE PREFERRED EMBODIMENT

Figure 1:
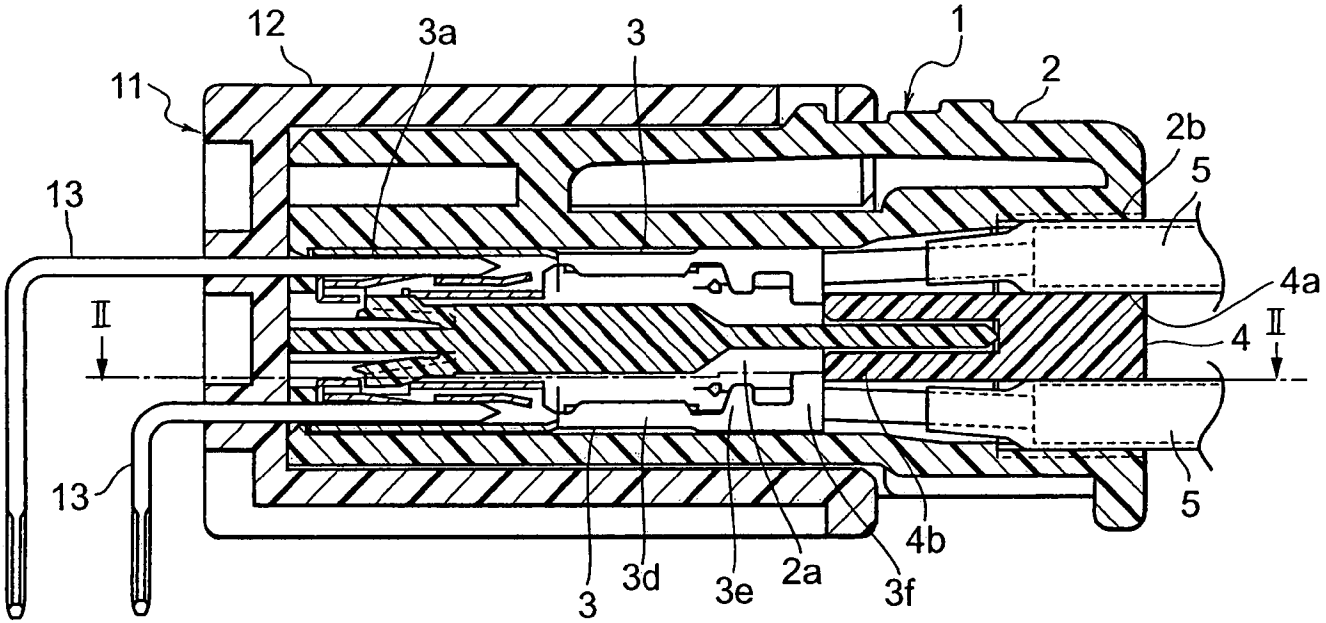
FIG. 1 is a sectional view showing a cable connector according to one embodiment of the present invention when the cable connector is fitted to a mating connector.
Figure 2:
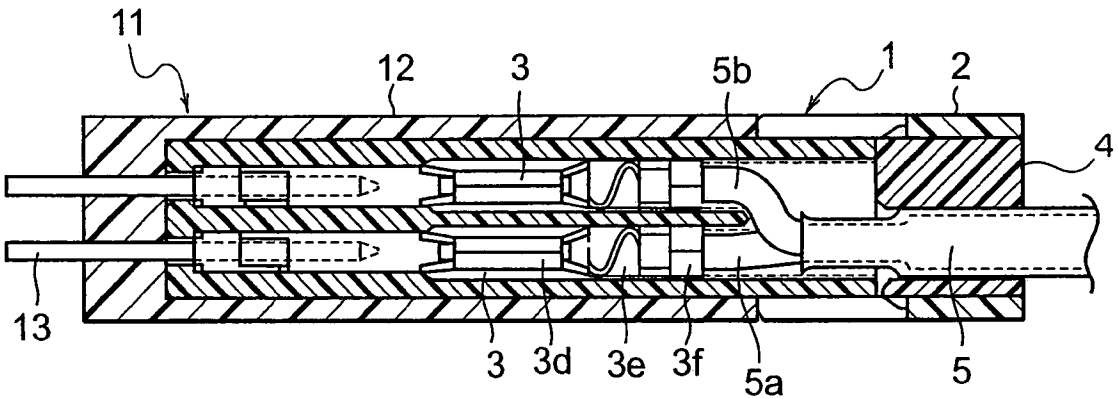
FIG. 2 is a sectional view taken along a line II—II in FIG. 1.
Figure 3:
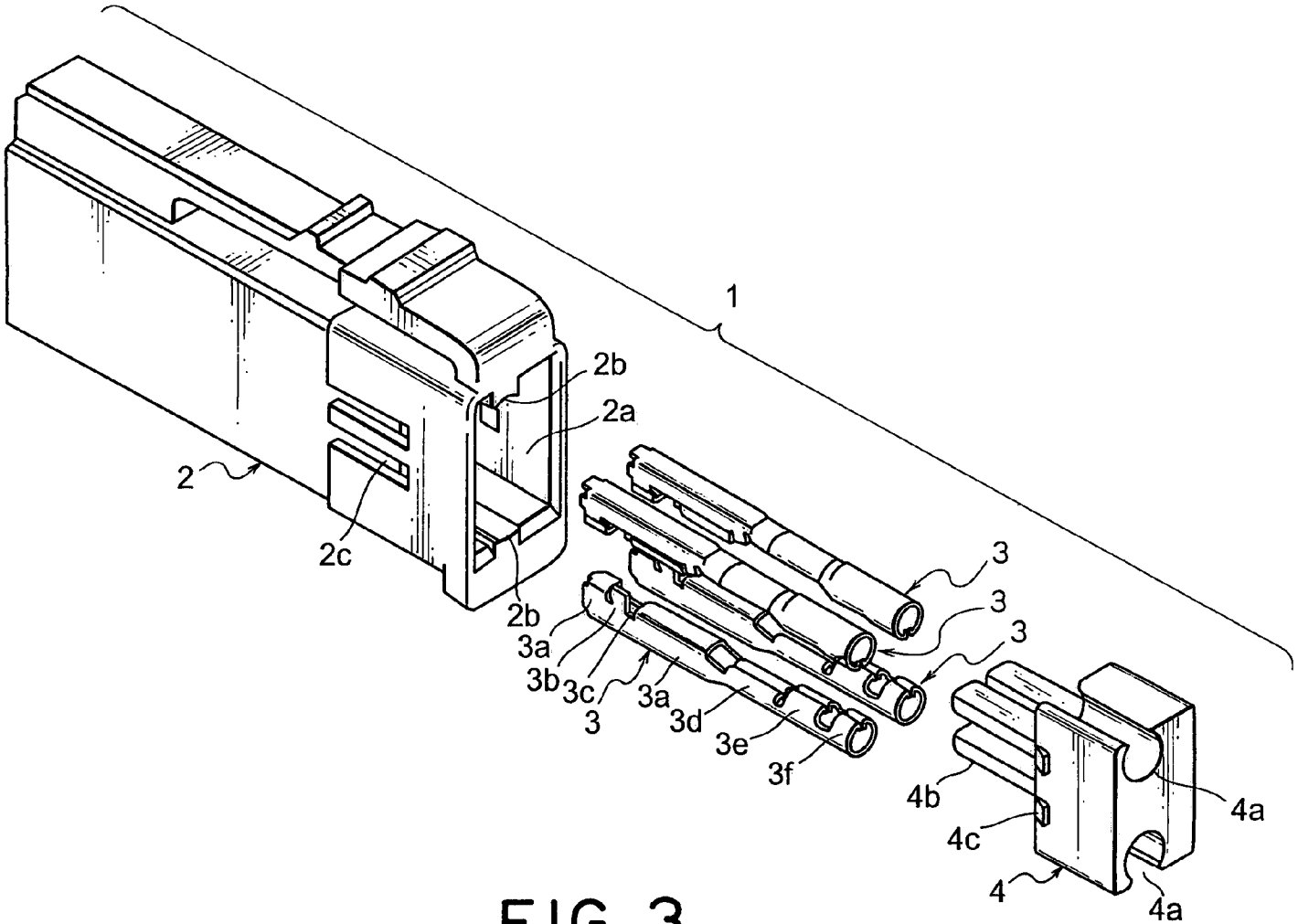
FIG. 3 is an exploded perspective view of the cable connector illustrated in FIGS. 1 and 2.

Referring to FIGS. 1 through 3, description will be made of a cable connector according to an embodiment of the present invention together with a mating connector and two coaxial cables.

The cable connector 1 illustrated in the figure is a coaxial plug connector of a socket type and will hereinafter be called a socket connector 1. The mating connector 11 illustrated in the figure is a coaxial receptacle connector of a pin type and will hereinafter be called a pin connector 11.

As well known, each of the coaxial cables 5 has a conductive core wire, an insulating core wire coating portion coating the core wire, a conductive shield wire surrounding the core wire coating portion, and a shield wire coating portion comprising a shrinkable tube and coating the shield wire. For convenience of description, a combination of the core wire and the core wire coating portion will be called a core wire portion 5*a*. Similarly, a combination of the shield wire and the shield wire coating portion will be called a shield wire portion 5*b*.

The socket connector 1 comprises a socket-side insulator 2, a plurality of conductive socket contacts 3, four in number, and an insulating retainer 4. The socket-side insulator 2 has a generally rectangular cylindrical shape and is provided with a receiving portion 2*a* having a generally rectangular space section and formed at its center to penetrating the socket-side insulator 2. Each of the socket contacts 3 has a generally cylindrical shape and inserted into the receiving portion 2*a* from a rear portion thereof to be held in the receiving portion 2*a*.

The retainer 4 has a generally rectangular solid shape and is inserted and held in the rear portion of the receiving portion 2*a*. The retainer 4 has a pair of upper and lower grooves 4*a* as cable holding portions for holding the coaxial cables 5, respectively. Each groove 4*a* is defined along a cylindrical surface in conformity with an outer contour of each coaxial cable 5. The retainer 4 has a front surface provided with a plurality of secondary locking protrusions 4*b* of a rectangular rod-like shape, four in number, and a pair of side surfaces each of which is provided with a pair of engagement protrusions 4*c*.

On the other hand, the receiving portion 2*a* has a rearward inner wall provided with a pair of upper and lower insulator-side holding portions 2*b*. Each of the insulator-side holding portions 2*b* has a curved surface faced each groove 4*a* and defined along a cylindrical surface. Thus, a combination of the curved surface of the insulator-side holding portion 2*b* and the groove 4*a* faced thereto forms a substantially cylindrical surface.

The pin connector 11 comprises a pin-side insulator 12 and a plurality of conductive pin contacts 13, four in number, held by the pin-side insulator 12. Into the pin-side insulator 12, the socket contacts 3, the retainer 4, and the coaxial cables 5 are inserted from the rear portion of the receiving portion 2*a*. When the socket connector 1 and the pin connector 11 are connected to each other as illustrated in FIGS. 1 and 2, the pin-side insulator 12 is fitted over a front portion of the socket-side insulator 2 and the pin contacts 13 are inserted from a front portion of the receiving portion 2*a*.

Each of the socket contacts 3 has an integral structure including a pin contact inserting portion 3*a* having a generally rectangular cylindrical shape, a rotation stopper portion 3*b* standing up from an intermediate position of the pin contact inserting portion 3*a*, a primary locking portion 3*c* formed by a cut portion adjacent to the rotation stopper portion 3*b*, a wire crimping barrel 3*d*, a coating crimping barrel 3*e*, and a secondary locking barrel 3*f* successively formed in this order from a front side towards a rear side. The pin contact inserting portion 3*a* is a portion adapted to receive the pin contact 13 to be inserted therein and brought into contact therewith. The rotation stopper portion 3*b* is a portion engaged with the socket-side insulator 2 to prevent the rotation of the socket contact 3. The primary locking portion 3*c* is a portion engaged with the socket-side insulator 2 to prevent the socket contact 3 from being released rearward. The wire crimping barrel 3*d* is a portion for crimping the core wire or the shield wire of the coaxial cable 5. The coating crimping barrel 3*e* is a portion for crimping the core wire coating portion or the shield wire coating portion of the coaxial cable 5. The secondary locking barrel 3*f* is a portion engaged with the secondary locking protrusion 4*b* of the retainer 4 to prevent the socket contact 3 from being released rearward.

Next, description will be made of an operation of connecting the two coaxial cables 5 and the four socket contacts 3 and an operation of holding the socket contacts 3 to the retainer 4.

At first, the core wire portion 5*a* and the shield wire portion 5*b* of one of the coaxial cables 5 are branched and separated. The core wire of the core wire portion 5*a* is exposed and is crimped on the wire crimping barrel 3*d* of the socket contact 3 on a lower front side in FIG. 3. In addition, the core wire coating portion is crimped on the coating crimping barrel 3*e*. Next, the shield wire of the shield wire portion 5*b* of the coaxial cable 5 is exposed and crimped on the wire crimping barrel 3*d* of the socket contact 3 on a lower rear side in FIG. 3. In addition, the shield wire coating portion, i.e., the shrinkable tube is crimped on the coating crimping barrel 3*e*.

Similarly, the core wire portion 5*a* and the shield wire portion 5*b* of another coaxial cable 5 are crimped on the socket contacts 3 on an upper front side and on an upper rear side, respectively.

The four socket contacts 3 connected to the coaxial cables 5 are fitted into the socket-side insulator 2. The two coaxial cables 5 are pushed into the grooves 4*a* of the retainer 4 in a radial direction, respectively. Thereafter, until forward ends of the four secondary locking protrusions 4*b* are brought into contact with rear ends of the secondary locking barrels 3*f* of the four socket contacts 3, respectively, the retainer 4 is pushed into the socket-side insulator 2. As a result, the grooves 4*a* of the retainer 4 and the holding portions 2*b* of the socket-side insulator 2 clamp the coaxial cables 5 in cooperation. Thus, since the coaxial cables 5 are clamped by the socket-side insulator 2 and the retainer 4 and are therefore stably held. After the coaxial cables 5 are fitted into the socket-side insulator 2, a connecting portion of each of the core wire and the shield wire of the coaxial cable 5 is received in the socket-side insulator 2 and is easily protected against bending force.

When the socket contacts 3 are fitted into the receiving portion 2*a* of the socket-side insulator 2, the rotation stopper portion 3*b* is brought into contact with the inner wall of the receiving portion 2*a* to thereby prevent the rotation of each socket contacts 3. The primary locking portion 3*c* is locked by a lance (not shown) formed in the receiving portion 2*a* of the socket-side insulator 2 and, therefore, the socket contact 3 is prevented from being released from the receiving portion 2*a*. Furthermore, the socket contact 3 is secondarily locked by the retainer 4 and, therefore, more reliably prevented from being released from the receiving portion 2*a*. When the retainer 4 is fitted into the receiving portion 2*a*, the engagement protrusions 4*c* are engaged with a pair of the grooves 2*c* formed on each side surface of the socket-side insulator 2. Therefore, the retainer 4 is prevented from being undesirably released from the socket-side insulator 2.

As illustrated in FIGS. 1 and 2, when the socket connector 1 and the pin connector 11 are fitted to each other, an end portion of each pin contact 13 is inserted into the pin contact inserting portion 3*a* of each socket contact 3 in contact therewith. Therefore, the socket and the pin connectors 1 and 11 are electrically connected to each other. Since the coaxial cable 5 is branched and separated into the core wire portion 5*a* and the shield wire portion 5*b*, the degree of freedom in designing a contact array is high when a multi-cable structure is adopted.

While the present invention has thus far been described in conjunction with a single embodiment thereof, it will be readily possible for those skilled in the art to put this invention into practice in various other manners without departing from the scope of this invention. For example, although the description is made about the coaxial cables, this invention is also applicable to other various types of cables.

What is claimed is:

1. A connector to be connected to a cable having a core wire, the connector comprising:

a contact having a wire crimping barrel crimped on the core wire and a locking barrel;

an insulator holding the contact and having a rear portion through which the cable is extracted; and a retainer fitted into the rear portion of the insulator, the retainer including:

a locking portion engaged with the locking barrel to prevent the contact from being released rearward from the insulator; and a cable holding portion for holding the cable in cooperation with the insulator, the cable holding portion and the insulator clamping the cable therebetween when the cable is connected to the connector.

2. The connector according to claim 1, wherein the cable further has a core wire coating portion coating the core wire, the contact further having a coating crimping barrel crimped on the core wire coating portion.

3. The connector according to claim 1, wherein the contact has a locking portion engaged with the insulator to prevent the contact from being released rearward from the insulator.

4. The connector according to claim 1, wherein the contact has a rotation stopper portion engaged with the insulator to prevent a rotation of the contact.

5. The connector according to claim 1, wherein the retainer has an engagement portion engaged with the insulator to prevent the retainer from being released rearward from the insulator.

6. The connector according to claim 1, wherein the insulator has an insulator-side holding portion formed at a position corresponding to the cable holding portion, the cable holding portion and the insulator-side holding portion cooperatively clamping the cable when the retainer is fitted into the insulator.

7. The connector according to claim 6, wherein the cable holding portion has a groove for receiving the cable, the insulator-side holding portion protruding towards the cable holding portion to push the cable into the groove.

8. The connector according to claim 7, wherein the groove is defined along a cylindrical surface.

9. The connector according to claim 7, wherein the insulator-side holding portion has a curved surface defined along a cylindrical surface and faced to the groove.

10. The connector according to claim 1, wherein the cable further has a shield wire and a shield wire coating portion coating the shield wire, the connector having an additional contact held by the insulator and connected to the shield wire.

11. The connector according to claim 10, wherein the additional contact has a wire crimping barrel crimped on the shield wire, a coating crimping barrel crimped on the shield wire coating portion, and a locking barrel.

12. The connector according to claim 11, wherein the retainer has a locking portion engaged with the locking barrel of the additional contact to prevent the additional contact from being released rearward from the insulator.

13. A connector to be connected to a coaxial cable having a core wire, a core wire coating portion coating the core wire, a shield wire, and a shield wire coating portion coating the shield wire, the connector comprising:

first and second contacts;

an insulator holding the first and the second contacts and having a rear portion through which the coaxial cable is extracted; and a retainer held by the insulator, the first contact including:

a wire crimping barrel crimped on the core wire; and a locking barrel for locking the first contact, the second contact including:

a wire crimping barrel crimped on the shield wire; and a locking barrel for locking the second contact, the retainer including:

first and second locking portions fitted into a rear portion of the insulator and engaged with the locking barrels of the first and the second contacts to lock the first and the second contacts, respectively; and a cable holding portion for holding the coaxial cable in cooperation with the insulator, the cable holding portion and the insulator clamping the coaxial cable therebetween when the coaxial cable is connected to the connector.

14. The connector according to claim 13, wherein the coaxial cable further has a core wire coating portion coating the core wire and a shield wire coating portion coating the shield wire, the first contact further including a coating crimping barrel crimped on the core wire coating portion, the second contact further including a coating crimping barrel crimped on the shield wire coating portion.

* * * * *